United States Patent [19]

Tubbesing et al.

[11] Patent Number: 5,052,286

[45] **Date of Patent: * Oct. 1, 1991**

[54] ROOF RIDGE VENTILATOR

[75] Inventors: Robert A. Tubbesing; Bruce D. Carter, both of St. Louis, Mo.

[73] Assignee: Greenstreak Plastic Products Company, St. Louis, Mo.

[ * ] Notice: The portion of the term of this patent subsequent to Sep. 18, 2007 has been disclaimed.

[21] Appl. No.: 497,977

[22] Filed: Apr. 27, 1990

Related U.S. Application Data

[63] Continuation of Ser. No. 364,144, Jun. 12, 1989, Pat. No. 4,957,037.

[51] Int. Cl.[5] ..... F24F 7/02

[52] U.S. Cl. ..... 98/42.21

[58] Field of Search ..... 98/42.21; 52/199

[56] References Cited

U.S. PATENT DOCUMENTS

| | | | |
|---|---|---|---|
| Re. 27,943 | 3/1974 | Smith | 98/42.21 |
| 2,799,214 | 7/1937 | Rouse | 98/42.21 |
| 3,079,853 | 3/1963 | Smith | 98/42.21 |
| 3,303,733 | 2/1967 | Medlycott et al. | 83/83 |
| 3,481,263 | 12/1969 | Belden | 98/42.21 |
| 3,660,955 | 5/1972 | Simon | 52/420 |
| 3,949,657 | 4/1976 | Sells | 98/42.21 |
| 4,090,435 | 5/1978 | Vallée | 98/42.21 |
| 4,280,399 | 7/1981 | Cunning | 98/42.21 |
| 4,325,290 | 4/1982 | Wolfert | 98/42.21 |
| 4,554,862 | 11/1985 | Wolfert | 98/42.21 |
| 4,621,569 | 11/1986 | Fioratti | 98/42.2 |
| 4,642,958 | 2/1987 | Pewitt | 52/302 |
| 4,643,080 | 1/1987 | Trostle et al. | 98/42.21 |
| 4,676,147 | 6/1987 | Mankowski | 98/42.21 |
| 4,817,506 | 4/1989 | Cashman | 98/42.21 |
| 4,924,761 | 5/1990 | MacLeod et al. | 98/42.21 |

FOREIGN PATENT DOCUMENTS

| | | | |
|---|---|---|---|
| 66838 | 12/1982 | European Pat. Off. | 98/42.2 |
| 542984 | 2/1932 | Fed. Rep. of Germany | 98/42.21 |
| 3018051 | 11/1981 | Fed. Rep. of Germany | 98/42.21 |
| 84/02970 | 8/1984 | PCT Int'l Appl. | 52/199 |

*Primary Examiner*—Harold Joyce

*Attorney, Agent, or Firm*—Polster, Polster andd Lucchesi

[57] ABSTRACT

A roof ridge ventilator for an open roof ridge has a one-piece molded plastic elongated body having a hinged area to facilitate bending along the open roof ridge and mounting to adjacent sloping roof surfaces in proximity to the open roof ridge. Integral underlying supporting structure supports the roof ridge ventilator above the sloping roof surfaces and includes an end wall on opposite sides of the roof ridge ventilator. A series of upwardly facing vents are provided in the vicinity of each end wall for ventilating air from beneath the roof through the open roof ridge and through the upwardly facing vents to atmosphere. An air deflector extends between each end wall and the upwardly facing vents to direct wind and wind driven water flowing upwardly along a sloping roof surface to follow a path above and over the upwardly facing vents, while also creating a negative pressure differential above the upwardly facing vents to assist in ventilating air beneath the roof. The integral underlying supporting structure also serves as baffle elements to disrupt the flow of wind and wind driven water which might enter water weep openings in the end walls so as to re-direct any water within the roof ridge ventilator to drain from the water weep openings, without entry into the open roof ridge.

11 Claims, 4 Drawing Sheets

ROOF RIDGE VENTILATOR

This is a continuation application of Ser. No. 364,144 filed June 12, 1989, now U.S. Pat. No. 4,957,037.

BACKGROUND OF THE INVENTION

The present invention relates to a roof ridge ventilator, and more particularly, to a roof ridge ventilator which ventilates air from beneath a roof, while also causing outside air to assist in removing air from beneath the roof, without interfering with upwardly facing vent openings.

The need for attic ventilation is well established and is two-fold in nature: reduction of summer heat build-up and preventing winter moisture condensation.

In summer, the principal source of attic heat is direct sunlight (radiated heat) on the roof of a home. Unless ventilated, intense attic heat is transmitted to and through the ceiling surfaces of the living space below. Not only do rooms become hotter, this further adds to the air conditioning requirement, both in the size of the unit needed and in operating costs. While ceiling insulation retards the rate at which heat flows to the rooms below, ventilating heat from the attic makes the insulation more effective and reduces the quantity of heat stored in the insulation. Ventilation also provides quicker and more complete cooling of the attic during the night, while also minimizing or limiting seasonal build-up of heat.

In winter, ventilating the attic space is equally important. The trend toward the use of insulation, in order to reduce heat flow from the attic to living quarters during the summer and heat loss in the winter, has been accompanied by tighter new home construction. Specifically, tighter new home construction is designed to prevent outside air from entering the home, while preventing the escape of interior air. While tighter new home construction coupled with greater use of insulation does in fact seal the home from outside air while preventing the escape of interior air, little consideration has been given to the release of water vapor into the home. The use of automatic laundry equipment, more frequent use of bath and shower facilities and the addition of humidifiers to heating equipment has created greater water vapor in the home. As a result, enough water vapor can escape to the attic to condense on cold inner roof surfaces, and in some cases, the amount of water vapor has been sufficient to saturate the rafters and roof sheathing, causing serious deterioration. The need for winter time attic ventilation, in addition to summer attic ventilation, has therefore, become readily apparent.

There are a number of different types of attic ventilators including roof louvers (with or without a turbine wheel activated by the wind to draw air out of the attic), gabled end louvers, soffit vents, roof ridge vents, or a combination of one or more of the above. While there are advantages and disadvantages to each of the foregoing types of roof ventilating systems, the present invention is directed to a roof ridge ventilator which, as will be made more apparent from the discussion that follows, enjoys more advantages, without the disadvantages of the other attic ventilation systems, as will become apparent.

Prior art roof ridge ventilators may be categorized generally into two different: those which are made of metal such as aluminum or zinc, and those which are molded from one or more plastic parts. The metal roof ridge ventilators, formed in one or more metal parts, typically include a top or roof cover for overhanging the open roof ridge with a series of louvered vent openings provided in undersurfaces of the top or cover. Wind deflectors or baffles associated with water weep openings are provided on opposite sides of such roof ridge ventilators generally adjacent an elongated ridge or groove, with the baffles serving to direct wind across the top or cover of the roof ridge ventilator while the vents openings on the undersurface of the top or cover enable air to be vented from beneath the roof. Some prior art examples of such metal roof ridge ventilators are shown in U.S. Pat. Nos. 3,079,853; 3,303,773; 4,554,862 and 4,643,080.

Other examples of wind deflector or baffle features in metal roof ridge ventilators are shown in U.S. Pat. Nos. 4,090,435; 4,325,290; 4,621,569 and 4,642,958. In some cases, the wind deflector or baffle structure is associated with louvers or vents to allow outside air to be directed away from the vents through which the inside air is ventilated.

Roof ridge ventilators which are molded as a single unit or in a plurality of parts are shown in U.S. Pat. Nos. 3,949,657; 4,280,399; 4,676,147; 4,817,506 and RE 27,943. In each of these aforementioned patents, one or more molded plastic parts form a roof ridge ventilator allowing air to be readily exhausted through vent openings provided in the roof ridge ventilator, while at the same time preventing outside air from being directed into the roof ridge ventilator.

Although the above and other prior art designs have worked well for the purposes intended, there are numerous disadvantages. In addition to the prior art designs requiring multiple part constructions, they do not effectively cause outside air to move past vent openings, but instead allow air to blow in the vent openings. At the same time, the prior art designs do not allow efficient cubic feet of air movement per foot of ventilation, as is required in construction standards and specifications. In addition, prior art designs do not prevent snow, rain or any other kind of moisture from getting inside the roof ridge ventilator, and thus may cause deterioration problems beneath the roof.

SUMMARY OF THE INVENTION

Among the several objects and advantages of the present invention include:

The provision of a new and improved roof ridge ventilator which overcomes the aforenoted deficiencies of the prior art;

The provision of a new and improved roof ridge ventilator made of one-piece molded plastic construction;

The provision of the aforementioned roof ridge ventilator which includes a series of upwardly facing vent openings, together with an air deflector or baffle which acts as a venturi or airfoil to keep air air moving past the upwardly facing vent openings, instead of blowing in, so as to create a negative pressure differential above the upwardly facing vent openings to assist in evacuating air therethrough from beneath the roof;

The provision of the aforementioned roof ridge ventilator which allows more cubic feet of air movement through the upwardly facing vent openings, while at the same time keeping out insects and foreign debris due to the restricted size of such vent openings;

The provision of the aforementioned roof ridge ventilator, which, in addition to providing the aforementioned air flow and movement, will not allow snow, rain or any other kind of moisture to enter the open roof ridge;

The provision of the aforementioned roof ridge ventilator which provides an extremely low profile mounted on a roof, thereby giving roofs a sleek appearance, as well;

The provision of the aforementioned roof ridge ventilator including integral underlying supporting structure for supporting the roof ridge ventilator above the sloping roof surfaces including interior baffle and supporting elements formed as I-beam shaped reinforcing bars in alternating and overlapping relationship to one another;

The provision of the aforementioned roof ridge ventilator which includes separate flexible sealing inserts for sealing opposite transverse ends of the roof ridge ventilator, and further includes complementary interfitting sections along the opposite transverse ends to facilitate interfitting of a plurality of roof ridge ventilators with respect to one another across the open roof ridge;

The provision of the aforementioned roof ridge ventilator which is molded from ultra-violet and oxidation-stabilized polypropylene as a long lasting and durable product; and The provision of the aforementioned roof ridge ventilator which is economically and efficiently molded as a one piece unit, facilitates stacking for shipment and storage with a series of roof ridge ventilators; meets or exceeds all national building code requirements; enables a shingle to be applied across the ridge cap thereof; and is otherwise well adapted for the purposes intended.

Briefly stated, the roof ridge ventilator of the present invention is constructed for use along an open roof ridge between sloping roof surfaces. The roof ridge ventilator comprises a one-piece molded plastic elongated body including a generally rectangular-shaped base sheet member with opposing pairs of sides and having a hinged area in a median portion thereof which is generally parallel to one opposing pair of sides to facilitate bending of the base sheet member along the open roof ridge and mounting to the sloping roof surfaces in proximity to the open roof ridge. Integral underlying supporting structure is provided for supporting the base sheet member above each sloping roof surface and includes an end wall extending generally parallel to and being integrally attached to each of two opposite sides of the base sheet member while also extending generally transverse to the base sheet member. A series of upwardly facing vents are provided in the base sheet member in the vicinity of and along the length of each end wall for ventilating air from beneath the roof through the open roof ridge and then through the upwardly facing vents to atmosphere. An air deflector extends between each end wall and the upwardly facing vents of the base sheet member and is positioned to direct wind and wind driven water flowing upwardly along a sloping roof surface to follow a path above and over the upwardly facing vents, while also creating a negative pressure differential above the upwardly facing vents to assist in ventilating air beneath the roof.

Each upwardly facing vent opening is restricted in size to prevent the entry of nesting insects, but is configured, arranged and dimensioned to provide fifteen square inches per lineal foot of net vent-free area for air ventilation. The upwardly facing vent openings comprise two adjacent rows of upwardly facing vents each containing a series of elongated and closely positioned upwardly facing vent openings.

A series of spaced water weep openings along a lower edge of each end wall permits rainwater entering the roof ridge ventilator through the upwardly facing vents or otherwise to be drained therefrom through the water weep holes, without entering the open roof ridge. The water weep openings are larger than each upwardly facing vent opening forming the upwardly facing vents.

Each air deflector is angularly offset outwardly both with respect to the base sheet member and its associated end wall, and is preferably offset at an angle of approximately 45° from a plane passing through each end wall. Each air deflector has a width substantially smaller than the height of the end wall and preferably has a width of approximately 0.250" with each end wall having a height of approximately 0.825".

The integral underlying supporting structure includes spaced interior baffle and supporting elements which are integrally connected to and underlie the base sheet member. The interior baffle and supporting elements comprise a series of I-beam shaped reinforcing bars extending between the base sheet member and the sloping roof surfaces. The I-shaped reinforcing bars are constructed to be alternatively laterally offset from one another on both sides of the hinged area. The I-shaped reinforcing bars are arranged in alternating rows extending at least partially laterally across in front of one another, with the I-shaped reinforcing bars of one of the rows being integrally connected to an associated end wall. The interior baffle and supporting elements are also constructed to disrupt the flow of wind and wind driven water which might enter via the water weep openings so as to re-direct any water within the roof ridge ventilator to drain from the water weep openings, without entry into the open roof ridge.

Separate flexible sealing inserts are mounted between the roof ridge ventilator and the sloping roof surfaces on opposite transverse ends thereof for closing the space between same and are held in place by spaced shoulder stops formed in the roof ridge ventilator adjacent the opposite transverse ends, together with an adhesive applied to one surface of the flexible inserts to facilitate attachment and mounting to the roof ridge ventilator adjacent the opposite transverse ends. Complementary interfitting sections along opposite transverse ends are also provided to facilitate interfitting of a plurality of roof ridge ventilators with respect to one another across the open roof ridge. The roof ridge ventilator is molded from ultra-violet and oxidation-stabilized polypropylene in a low profile roof vent construction to give a sleek appearance or configuration.

These and other objects and advantages of the present invention will be made more apparent from the ensuing description.

BRIEF DESCRIPTION OF THE DRAWINGS

Corresponding reference numerals will be used throughout the various figures of the drawings.

DESCRIPTION OF THE PREFERRED EMBODIMENTS

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

Figure 1:
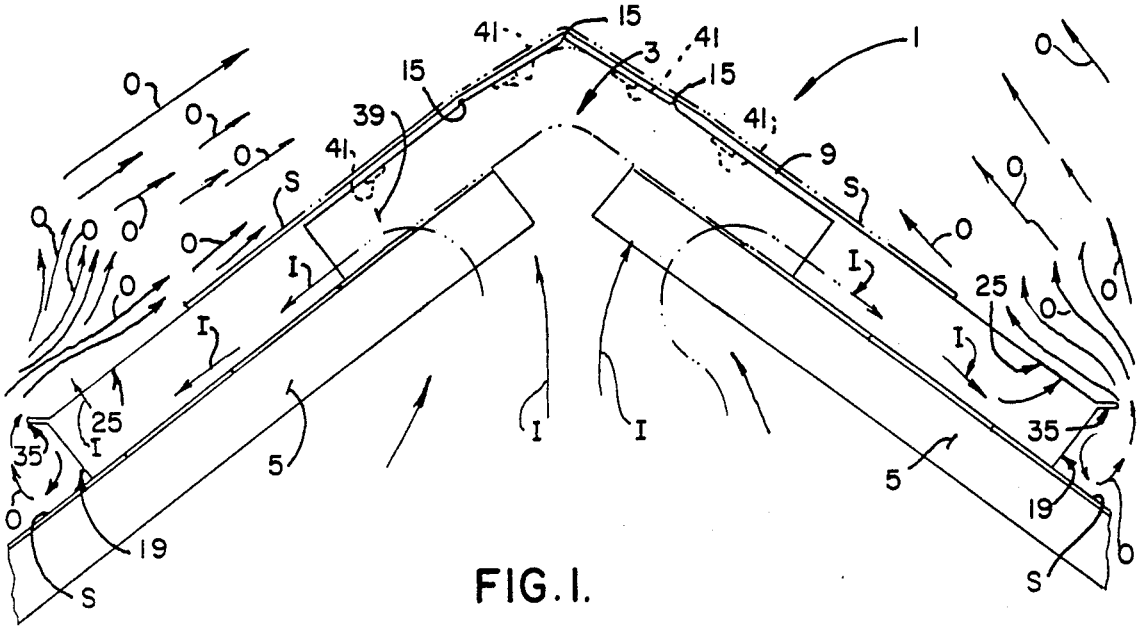
FIG. 1 is a fragmentary side elevational view of the roof ridge ventilator of the present invention illustrated as being mounted along an open roof ridge and attached to sloping roof surfaces forming a conventional residential roof.
Figure 2:
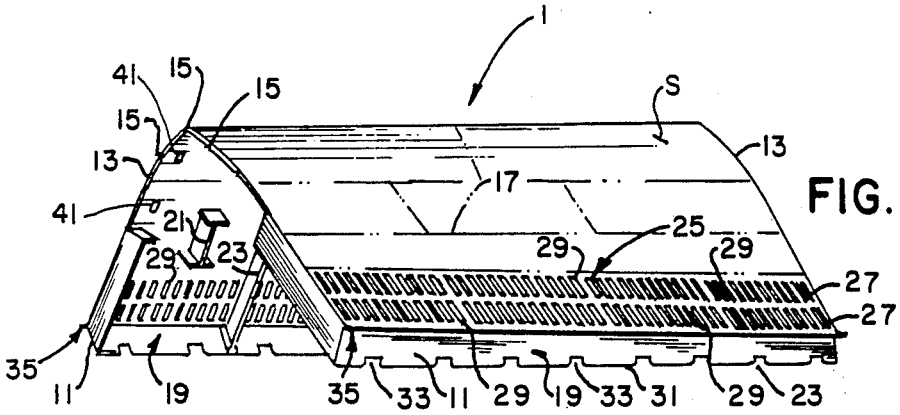
FIG. 2 is a reduced-in-size perspective view of the roof ridge ventilator of the present invention.
Figure 3:
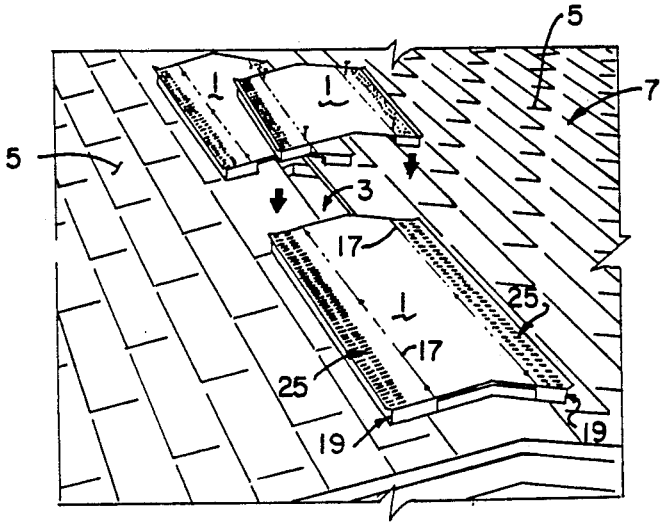
FIG. 3 is a further reduced-in-size perspective view illustrating the manner in which a series of similarly constructed roof ridge ventilators are mounted in interfitting and adjacent relationship to one another along the open roof ridge of the roof.
Figure 4:
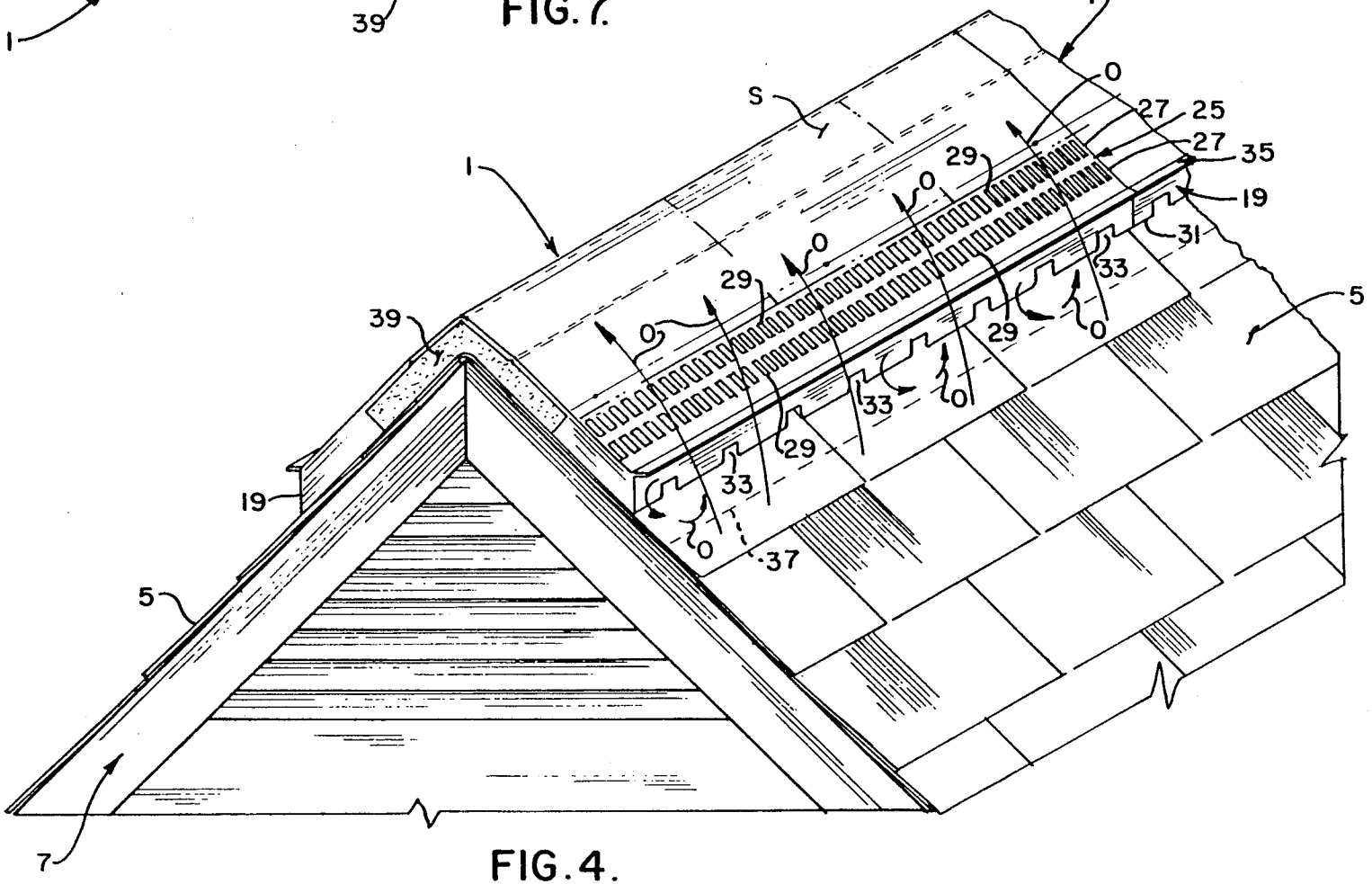
FIG. 4 is a fragmentary respective view illustrating the roof ridge ventilator of the present invention mounted along a sloping roof and also illustrating the use of flexible sealing inserts along a transverse end wall thereof.

The roof ridge ventilator 1 illustrated in the drawings is a one-piece molded plastic elongated body preferably made from ultra-violet and oxidation-stabilized polypropylene for long term use and durability against the adverse effects of light, moisture and other natural forces. As best illustrated in FIGS. 1, 3 and 4 of the drawings, the roof ridge ventilator 1 is adapted to be mounted along the open roof ridge 3 between sloping roof surfaces 5, 5 having shingles thereon as in a typical residential roof 7.

The one-piece molded plastic elongated rood ridge ventilator 1 is preferably constructed in a length of approximately 4' long by ¾" high by 16½" wide. As shown in FIG. 3 of the drawings, a series of roof ridge ventilators 1 are shown as being mounted in end-to-end relationship along the open roof ridge 3, and may also have complementary interfitting elements along transverse end surfaces, as will be discussed below. The very small height of the roof ridge ventilator 1 (approximately ¾") provides a very low profile so as to give the roof ridge ventilators a sleek appearance, as compared with other prior art designs. A standard shingle S (See FIGS. 1 and 4) may be used to cover the roof ridge ventilator 1, within upwardly facing openings on opposite sides thereof as will be described, in order to conceal the roof ridge ventilator and provide a pleasing appearance.

Figure 5:
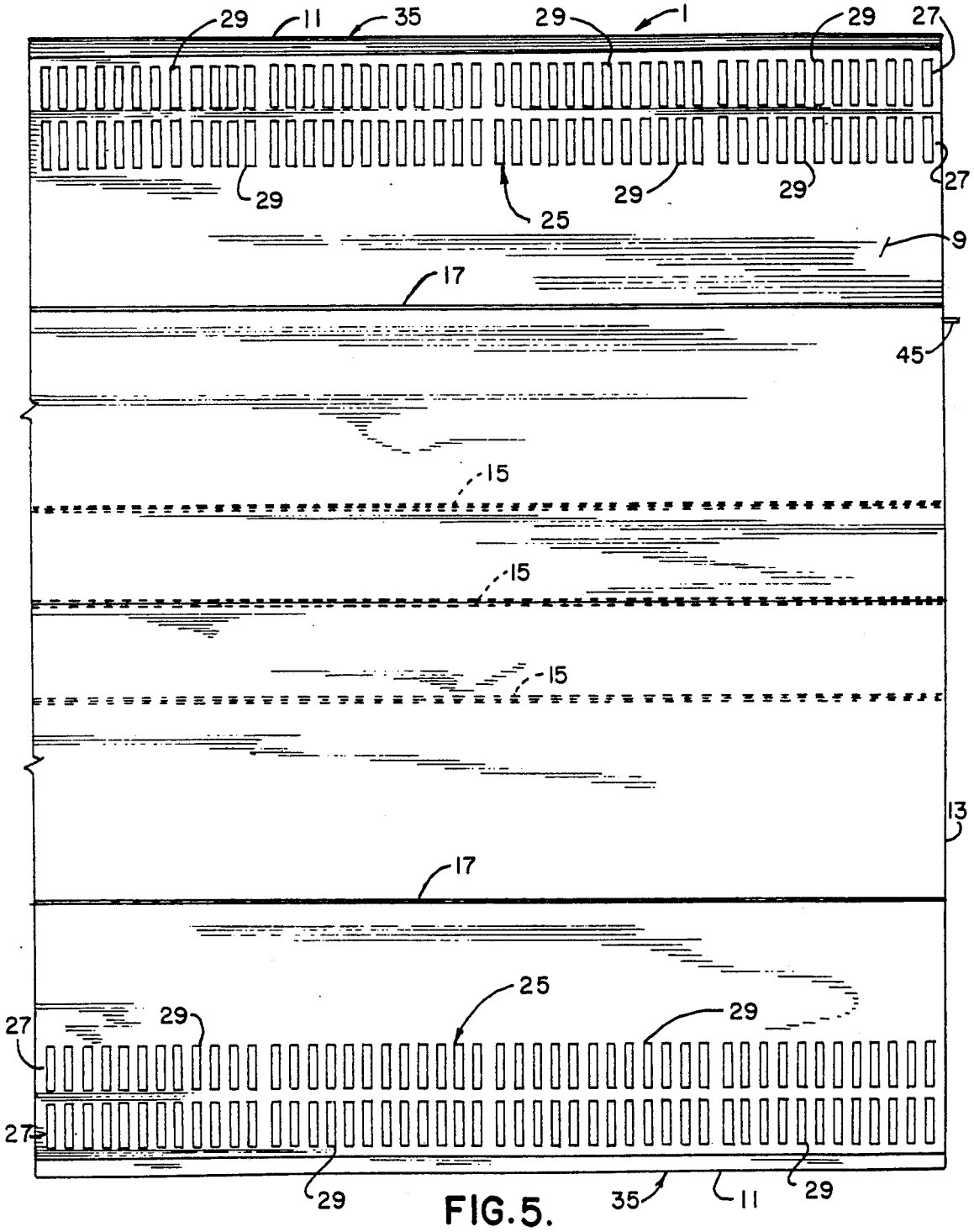
FIG. 5 is a fragmentary top plan view of the roof ridge ventilator of the present invention, prior to mounting to an open roof ridge.
Figure 8:
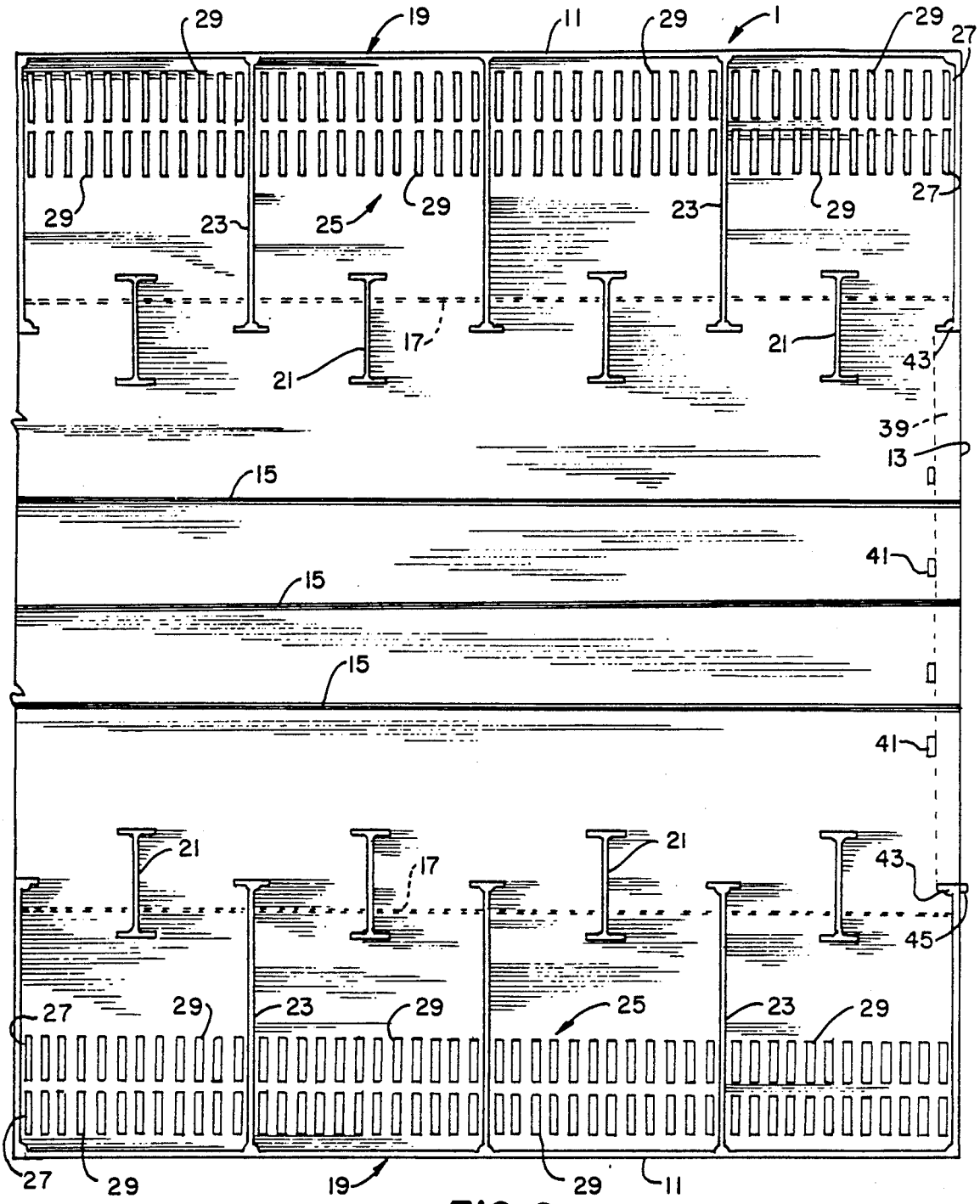
FIG. 8 is a fragmentary bottom plan view of the roof ridge ventilator of the present invention, prior to the mounting to an open roof ridge.
Figure 6:
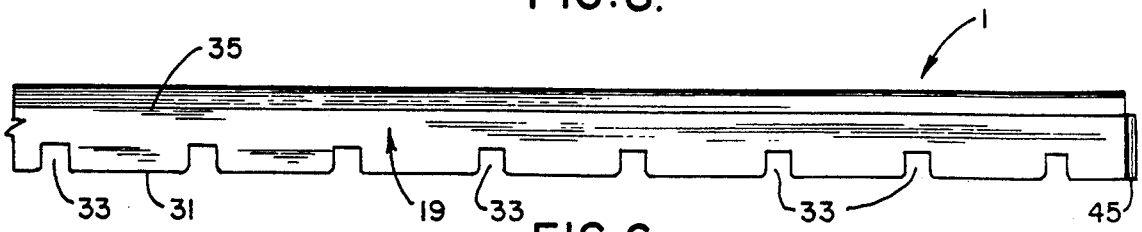
FIG. 6 is a fragmentary side elevational view of the roof ridge ventilator shown in FIG. 5.

As initially manufactured, each roof ridge ventilator 1 is injection molded as a one-piece element in generally planar relationship as shown in the top and bottom plan views of FIGS. 5 and 8 of the drawings. The elongated body forming the roof ridge ventilator 1 includes a generally rectangular-shaped base sheet member 9 with opposing pairs of sides 11, 11 extending longitudinally along the length of the ventilator 1 and opposing sides 13, 13, also forming opposite transverse ends of the base sheet member 9. Opposing pairs of longitudinally extending sides 11, 11 are generally parallel to generally longitudinally extending hinged areas 15, 15, 15 in the median portion of the base sheet member 9 to facilitate bending of the base sheet member 9 along the open roof ridge 3 and mounting of the same to the sloping roof surfaces 5, 5 in proximity to the open roof ridge 3, as best seen in FIG. 1 of the drawings. In order to attach the roof ridge ventilator to the sloping roof surfaces 5, 5 suitably sized roofing nails may be driven through and along the nail line 17, 17 formed on opposite sides of the hinged areas 15, 15, 15, in order to secure the roof ridge ventilator 1 in the desired position relative to the open roof ridge 3, as best seen in FIGS. 1 and 3–4 of the drawings.

Figure 7:
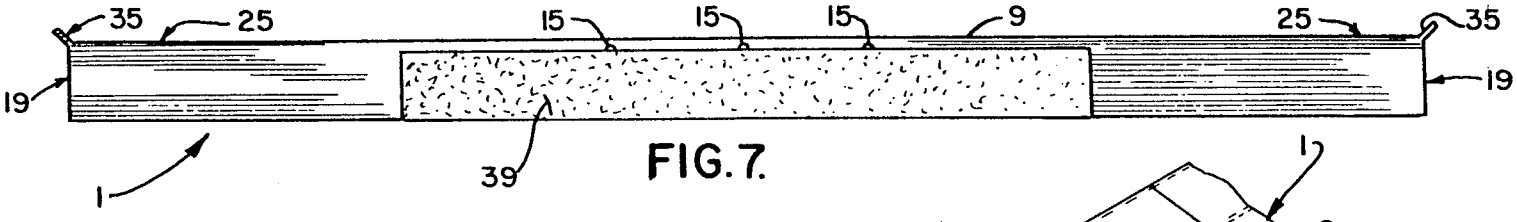
FIG. 7 is an end elevational view of the roof ridge ventilator with a flexible sealing insert assembled thereto.

Integral underlying supporting structure is provided for supporting the base sheet member 9 above each sloping roof surface 5, 5. Such integral underlying supporting structure includes an end wall 19, 19 extending generally parallel to and being integrally attached to each of the two opposite sides 11, 11 of the base sheet member 9. Each end wall 19 also extends generally transverse to the base sheet member 9 as best seen in FIGS. 1 and 7 of the drawings. The integral underlying supporting structure also preferably includes spaced interior baffle and supporting elements which are integrally connected to and underlie the base sheet member 9. Specifically, the interior baffle and supporting elements comprise a series of I-beam shaped reinforcing bars 21 arranged in one row with alternate longer reinforcing bars 23 in an adjacent row extending at least partially across the I-shaped reinforcing bars 21 in the first row. The longer I-shaped reinforcing bars 23 are also integrally connected to an associated end wall 19, thereby integrally connecting the end wall 19 and the base sheet member 9 along the undersurface of the roof ridge ventilator 1, as best seen in FIG. 8 of the drawings. The I-shaped supporting bars 21 and 23 in the two adjacent and overlapping rows also serve as interior baffle elements, as will be further described below.

A series of upwardly facing vents generally identified at 25 are provided in the base sheet member 9 in the vicinity of and along the length of each end wall 19, 19 for ventilating air from beneath the roof 7 through the open roof ridge 3 and then upwardly through the upwardly facing vents 25, 25 to atmosphere. Each of the upwardly opening vents 25, 25 adjacent each of the end walls 19, 19 are configured, arranged and dimensioned to provide 15 square inches per lineal foot of net vent-free area for air ventilation, in order to meet or exceed all national building codes. In this connection, each upwardly facing vent area 25 comprises two adjacent rows 27, 27 of elongated and closely positioned upwardly facing vent openings 29 which are restricted in size to prevent the entry of nesting insects or debris, but at the same time provide sufficient air flow openings for the 15 square inches per lineal foot of net vent free area. Each of the vent openings 29 have a length of approximately 0.625" and a width of 0.125" in each of the two adjacent row 27, 27.

At the lower edge 31 of each of the end walls 19, 19 are a series of spaced water weep openings 33 to permit water entering the roof ridge ventilator, from a pouring or falling rain, to enter the upwardly facing openings 29 of the upwardly facing vents 25, and then fall by gravity against the sloping roof surfaces 5 for drainage from the roof ridge ventilator 1 via the spaced water weep openings 33 along the lower edge 31 of each end wall 19. It will be appreciated that since the upwardly facing vents 25 are positioned directly above the sloping roof surfaces 5, no rain or moisture will fall into the open roof ridge 3, but rather will be drained by gravity through the spaced water weep openings 33 in each end wall 19.

In addition, the interior baffle and supporting elements 21 and 23 are constructed to not only serve as support elements, but serve as baffle elements so as to disrupt the flow of wind and wind driven water which enter via the water weep openings 33 so as to re-direct any water within the roof ridge ventilator to drain from the water weep openings 33, without entry into the open roof ridge 3.

In those cases where wind or wind driven water are directed upwardly along the sloping roof surfaces 5, such as in a hurricane or heavy thunderstorm, the roof ridge ventilator 1 is constructed to utilize these natural forces, without in any way obstructing or interfering with the normal function of the upwardly facing vents 25, 25 adjacent each of the end walls 19, 19. Specifically, in this connection, each of the end walls 19 is provided with an air deflector or air baffle 35 extending between each end wall 19 and the upwardly facing vents 25 of the base sheet member 9, with the air deflector or air baffle 35 positioned to direct wind and wind driven water flowing upwardly along a sloping roof surface 5 to follow a path above and over the upwardly facing vents 25, while also creating a negative pressure differential above the upwardly facing vents 25, in the form of a venturi or operating as an airfoil, to assist ventilating air via the upwardly facing vents 25.

Each air deflector or air baffle 35 is angularly offset outwardly both with respect to the base sheet member 9 and its associated end wall 19. Specifically, it has been found that as each air deflector is offset at an angle of approximately 45 degrees from a plane passing through each end wall 19, and with a width substantially smaller than the height of the end wall 19 from which it extends, it is most effective. In the roof ridge ventilator having the dimensional sizes as set forth above, preferably each air deflector 35 has a width of approximately 0.250" while each end wall 19 has a height of approximately 0.825", thus providing an air deflector 35 with a width substantially smaller than the height of the end wall 19.

Reference is now made to FIGS. 1 and 4 for a specific understanding of the manner in which the air deflector 35 operates in conjunction with the end wall 19 and adjacently positioned upwardly facing vents 25 in the base sheet member 19 of the roof ridge ventilator 7. In FIG. 1 of the drawings, inside air from beneath the roof 7, represented by arrows I, is shown as moving through the open roof ridge 3 and than beneath the roof ridge ventilator 1, including past the I-shaped supporting beams 21 and 23, for evacuation through the upwardly facing vents 25, 25 on each side thereof. The outside air, represented by the arrows O, is shown, on both sides of the roof ridge ventilator 1, as moving past the end walls 19, 19, the air deflectors 35, 35 and then moving past the roof ridge ventilator 1 along the upper surface thereof. Although FIG. 1 shows the outside air represented by arrows O as being simultaneously directed against the end walls 19, 19 and air deflectors 35, 35 on opposite sides of the roof ridge ventilator 1, in actuality, the roof ridge ventilator 1 will be subject to wind forces from one direction only during a wind storm, thunderstorm, hurricane, etc. Further, the outside air, represented by the arrows O on both sides of the roof ridge ventilator 1, is believed to be representative of the air movement in the vicinity of the end wall 19, air deflector 35 and air vents 25 on each side of the roof ridge ventilator 1, although the invisible wind forces have not been seen or calculated in any way.

Thus, it will be seen in FIG. 1 of the drawings, that the outside air O when it encounters the end wall 19, will create an air turbulence as shown by the outside air O moving in a circular direction, as seen immediately adjacent the end walls 19, 19, and representing air turbulence as the result of the end wall 19 and associated overhanging outwardly extending air deflector 35 on each side of the roof ridge ventilator 1. As the outside air O moves over the air deflector 35 on each side of the roof ridge ventilator 1, it will be seen that a venturi or airfoil effect will be created, with the outside air O moving over and above the upwardly facing vents 25, then along the remainder roof ridge ventilator until it escapes therefrom. The outside air O, radiating outwardly away from the negative pressure differential area will generally move in the arrow pattern illustrated in FIG. 1, until it moves away from the roof and into the atmosphere.

In actual testing as described below, it was discovered that the area of negative pressure differential, established by the venturi or airfoil effect, not only prevented the outside air O and wind driven water from entering the upwardly facing vents 25, but the negative pressure differential in the vicinity and above the upwardly facing vents 25 assisted the evacuation of inside air I through the upwardly facing vents 25. The construction, arrangement and dimensioning of the end wall 19, air deflector 35 and proximity location of the upwardly facing vents 25 enables the above results to take place. As illustrated in the drawings and in the actual samples made and tested, the edge of the upwardly facing vent openings 29 was separated by only 0.125" from the deflector 35, with both adjacent rows 27, 27 of the upwardly facing vents 25 extending laterally away from the air deflector 35 by a distance of 1.375".

In FIG. 4 of the drawings, the movement of the outside air represented by the arrows O is also shown as moving over and above the upwardly facing vents 25, with the dotted line 37 representing the area of air turbulence created by the end wall 19 and associated air deflector 35 (shown the arrows O moving in a circular path adjacent the end wall 19 and air deflector 35. This causes the air to move from approximately the dotted line 37 over and above the end wall 19 and air deflector 35 including adjacent upwardly facing vents 25 as represented by the arrows O in both FIGS. 1 and 4.

Before describing the actual tests that were made on the roof ridge ventilator 1, it will be noted in FIGS. 4 and 7 that a flexible insert 39, made from foam rubber or the like may be used for mounting between the roof ridge ventilator 1 and the sloping roof surfaces 5, 5 on opposite transverse ends thereof for closing the space between same, so as to effectively seal off the open roof ridge 3 opposite transverse ends of roof ridge ventilators 1, on each side of a home, as best illustrated in FIG. 7. Each of the flexible inserts 39 are held in place by a series of spaced shoulder stops 41 in conjunction with inwardly directed opposed flanges 43, 43 at each of the opposite sides or transverse ends 13 of each roof ridge ventilator 1, as best seen in FIG. 8 of the drawings, where the flexible insert 39 is shown in dotted lines as being held in position relative to the spaced shoulder stops 41 and the opposed generally directed flanges 43, 43. Each flexible insert also preferably includes an adhesive applied to one surface thereof to facilitate attachment and mounting to the roof ridge ventilator adjacent the opposite transverse ends 13, 13.

For complementary interfitting engagement between adjacent roof ridge ventilators 1, complementary interfitting fingers 45 extend outwardly a short distance outwardly and in alignment with one of the inwardly directed flanges 43, allowing each interfitting finger 45 of one roof ridge ventilator 1 to be slidingly received by the inwardly direct flange 43 of an adjacent roof ridge ventilator 1. The interfitting fingers 45 may be provided adjacent both inwardly directed flanges 43, 43 on each transverse end 13 of a roof ridge ventilator or on opposite alternate positions on the respective transverse ends 13, 13, as may be desired, in order to achieve the complementary interfitting of adjacent roof ridge ventilators 1 along the open roof ridge 1 in end-to-end relationship to one another, as is illustrated in FIGS. 3–4 of the drawings.

The roof ridge ventilator 1 was prototype tested for dynamic pressure water infiltration and static pressure structural performance, and exceeded the expectations of the inventors. The prototype roof ridge ventilator was attached by steel roofing nails to a wood shed test structure with sloping roof surfaces having shingles on the sloping roof surfaces, in a typical manner. The wood shed test structure, with prototype roof ridge ventilators, was installed in a strong test chamber and anchored to simulate attachment to joists and walls of a home. The wood shed test structure was located ten feet downwind from a 13" by 6" diameter propellor attached to a 2,100 horsepower aircraft engine wind generator. The wind speed at the wood shed test structure was determined by prior pitot tube calibration of engine rpm versus windspeed. Water spray was added to the airstream up stream of the wood shed test structure at a rate equal to an 8" per hour rain. The underside of the deck was visually observed for leakage and test materials were visually observed for damage during the test.

With water added to the air stream as noted above, the roof ridge ventilator was subjected to incrementally increased wind speeds for the time periods noted below:

| Wind Speed (mph) | Duration (minutes) |
|---|---|
| 50 | 5 |
| 60 | 5 |
| 70 | 5 |
| 80 | 1 |
| 90 | 1 |
| 100 | 1 |
| | 18 minutes total |

Test results showed no damages and no failures. Less than 0.2 ounces of leakage in the wood shed test structure occurred during the 18 minute test.

In addition to the above, the specimen was subjected to structural performance by static pressure by imposing the following negative pressure (outward acting) structural loads on the prototype roof ridge ventilator, each held for 10 seconds:

55.5 psf (pounds per square foot)

61.5 psf (pounds per square foot)

No damage and no failures were evident in this structural performance by static pressure test.

Accordingly, it was found that the roof ridge ventilator prototype that was tested for dynamic pressure water infiltration and static pressure structural performance performed beyond expectation, and most importantly, was found to meet or exceed all existing national building codes.

From the foregoing, it will now be appreciated that the roof ridge ventilator of the present invention achieves the aforementioned several objects and features of the invention, and other further advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. A roof ridge ventilator for an open roof ridge including a molded plastic body means including an elongated base sheet member extending over and mounted to sloping roof surfaces on both sides of said open roof ridge, the improvement comprising: a pair of end walls attached to said base member and extending both generally parallel to said open roof ridge while also extending at least partially transverse to said base sheet member, a series of upwardly facing vents provided in said molded plastic body means in the vicinity of and along each end wall for ventilating air from beneath the roof through the open roof ridge and then through the upwardly facing vents to atmosphere, said upwardly facing vents extending from adjacent an associated end wall at an angle which provides at least a substantially transverse component for said upwardly facing vents relative to its associated end wall, and an air deflector extending upwardly from each end wall adjacent the upwardly facing vents in said base sheet member, each said air deflector being positioned to direct wind and wind driven water flowing upwardly along a sloping roof surface to follow a path above and over the upwardly facing vents, while also creating a negative pressure differential above the upwardly facing vents to assist in ventilating air beneath the roof.

2. The roof ridge ventilator as defined in claim 1 wherein each upwardly facing vent opening is restricted in size to prevent the entry of nesting insects or debris.

3. The roof ridge ventilator as defined in claim 2 wherein each said air deflector also extends above the plane of the base sheet member.

4. The roof ridge ventilator as defined in claim 1 wherein each air deflector is angularly offset outwardly both with respect to said base sheet member and its associated end wall.

5. A roof ridge ventilator for an open roof ridge comprising a molded plastic body means including a generally rectangular-shaped base sheet member with opposing pairs of sides and having a hinged area in a median portion thereof which is generally parallel to one opposing pair of sides to facilitate bending of said base sheet member along the open roof ridge and mounting to sloping roof surfaces in proximity to said open roof ridge, underlying supporting structure for supporting said base sheet member above each sloping roof surface and including an end wall extending generally parallel to each of two opposite sides of said base sheet member, each end wall extending at least partially transverse to said base sheet member, a series of upwardly facing vents provided in said molded plastic body means in the vicinity of and along the length of each end wall for ventilating air from beneath the roof through the open roof ridge and then through the upwardly facing vents to atmosphere, said upwardly facing vents extending from adjacent an associated end wall at an angle which provides at least a substantially transverse component for said upwardly facing vents relative to its associated end wall, and an air deflector extending from each end wall adjacent the upwardly facing vents of said base sheet member, each said air deflector being positioned to direct wind and wind driven water flowing upwardly along a sloping roof surface to follow a path above and over the upwardly facing vents, while also creating a negative pressure differential above the upwardly facing vents to assist in ventilating air beneath the roof.

6. A roof ridge ventilator for an open roof ridge comprising molded plastic body means including a generally rectangular-shaped base sheet member with opposing pairs of sides and having a hinged area in a median portion thereof which is generally parallel to one opposing pair of sides to facilitate bending of said base sheet member along the open roof ridge and mounting to sloping roof surfaces in proximity to said open roof ridge, underlying supporting structure for supporting said base sheet member above each sloping roof surface and including an end wall extending generally parallel to and being integrally attached to each of two opposite sides of said base sheet member, each end wall extending at an angle which provides a substantially transverse component relative to said base sheet member, a series of upwardly facing vents provided in said molded plastic body means in the vicinity of and along the length of each end wall for ventilating air from beneath the roof through the open roof ridge and then through the upwardly facing vents to atmosphere, said upwardly facing vents extending from adjacent an associated end wall at an angle which provides at least a substantially transverse component for said upwardly facing vents relative to its associated end wall, and an air deflector extending upwardly from each end wall adjacent the upwardly facing vents of said base sheet member which is positioned to direct wind and wind driven water flowing upwardly along a sloping roof surface to follow a path above and over the upwardly facing vents while also creating a negative pressure differential above the upwardly facing vents to assist in ventilating air beneath the roof.

7. The roof ridge ventilator as defined in claim 6 wherein the air deflector also extends above the plane of the base sheet member.

8. The roof ridge ventilator as defined in claim 6 wherein each said air deflector is also angularly offset with respect to the plane of said base sheet member.

9. The roof ridge ventilator as defined in claim 8 wherein each air deflector further is angularly offset outwardly both with respect to said base sheet member and its associated side wall.

10. In a roof ridge ventilator for an open roof ridge including molded plastic body means having an elongated base sheet member extending over and mounted to sloping roof surfaces on both sides of said open roof ridge, the improvement comprising: a pair of end walls attached to said base member and extending both generally parallel to said open roof ridge while also extending an angle which provides a substantially transverse component relative to said base sheet member, a series of upwardly facing vents provided in said molded plastic body means in the vicinity of and along each end wall for ventilating air from beneath the roof through the open roof ridge and then through the upwardly facing vents to atmosphere, said upwardly facing vents extending from adjacent an associated end wall at an angle which provides at least a substantially transverse component for said upwardly facing vents relative to its associated end wall, and an air deflector extending upwardly from each end wall adjacent the upwardly facing vents in said base sheet member positioned to direct wind and wind driven water flowing upwardly along a sloping roof surface to follow a path above and over the upwardly facing vents while also creating a negative pressure differential above the upwardly facing vents to assist in ventilating air beneath the roof.

11. A roof ridge ventilator for an open roof ridge comprising a one-piece molded plastic elongated body including a generally rectangular-shaped base sheet member with opposing pairs of sides and having a hinged area in a median portion thereof which is generally parallel to one opposing pair of sides to facilitate bending of said sheet member along the open roof ridge and mounting to sloping roof surfaces in proximity to said open roof ridge, integral underlying supporting structure for supporting said base sheet member above each sloping roof surface and including an end wall extending generally parallel to and being integrally attached to each of two opposite sides of said base member, each end wall extending generally transverse to said base sheet member, a series of upwardly facing vents provided in said base sheet member in the vicinity of and along the length of each end wall for ventilating air from beneath the roof through the open roof ridge and then through the upwardly facing vents to atmosphere, said upwardly facing vents extending from adjacent an associated end wall at an angle which provides at least a substantially transverse component for said upwardly facing vents relative to its associated end wall, and an air deflector extending upwardly from each end wall adjacent the upwardly facing vents of said base sheet member which is positioned to direct wind and wind driven water flowing upwardly along a sloping roof surface to follow a path above and over the upwardly facing vents while also creating a negative pressure differential above the upwardly facing vents to assist in ventilating air beneath the roof, each end wall and associated air deflector being angularly offset outwardly both with respect to said base sheet member and its associated end wall.

* * * * *

UNITED STATES PATENT AND TRADEMARK OFFICE

CERTIFICATE OF CORRECTION

PATENT NO. : 5,052,286

DATED : October 1, 1991

INVENTOR(S) : Robert A. Tubbesing et al

It is certified that error appears in the above—identified patent and that said Letters Patent is hereby corrected as shown below:

Column 9, line 31 is "13" by 6"", should be -- 13' by 6" --;

Signed and Sealed this

Thirteenth Day of April, 1993

*Attest:*

STEPHEN G. KUNIN

*Attesting Officer*

*Acting Commissioner of Patents and Trademarks*